US009961733B2

(12) United States Patent
Nakano et al.

(10) Patent No.: US 9,961,733 B2
(45) Date of Patent: May 1, 2018

(54) POWER SUPPLY DEVICE AND LED LIGHTING APPARATUS

(71) Applicant: CCS Inc., Kyoto-shi, Kyoto (JP)

(72) Inventors: Sho Nakano, Kyoto (JP); Yuichiro Tanaka, Kyoto (JP)

(73) Assignee: CCS Inc., Kyoto-shi, Kyoto (JP)

( * ) Notice: Subject to any disclaimer, the term of this patent is extended or adjusted under 35 U.S.C. 154(b) by 0 days. days.

(21) Appl. No.: 15/128,905

(22) PCT Filed: Mar. 25, 2015

(86) PCT No.: PCT/JP2015/059044
§ 371 (c)(1),
(2) Date: Sep. 23, 2016

(87) PCT Pub. No.: WO2015/147026
PCT Pub. Date: Jan. 10, 2015

(65) Prior Publication Data

US 2017/0111967 A1 Apr. 20, 2017

(30) Foreign Application Priority Data

Mar. 28, 2014 (JP) ..... 2014-069963

(51) Int. Cl.
*H05B 33/08* (2006.01)

(52) U.S. Cl.
CPC ..... *H05B 33/0842* (2013.01); *H05B 33/0815* (2013.01); *H05B 33/0827* (2013.01); *H05B 33/0887* (2013.01)

(58) Field of Classification Search
CPC ..... H05B 33/0815; H05B 33/0818; H05B 33/0884; H05B 33/0809; H05B 33/0848; H05B 33/0896
(Continued)

(56) References Cited

U.S. PATENT DOCUMENTS 9,609,703 B2 * 3/2017 Zhang ..... H05B 33/0815
2004/0196225 A1 10/2004 Shimada
(Continued)

FOREIGN PATENT DOCUMENTS

CN 102316648 A 1/2012
CN 103152916 A 6/2013
(Continued)

OTHER PUBLICATIONS

ISA Japan Patent Office, International Search Report Issued in Application No. PCT/JP2015/059044, dated May 26, 2015, WIPO, 2 pages.
(Continued)

*Primary Examiner* — Douglas W Owens
*Assistant Examiner* — Syed M Kaiser
(74) *Attorney, Agent, or Firm* — Alleman Hall Creasman & Tuttle LLP

(57) ABSTRACT

Provided is a power supply device capable of preventing a drop in the voltage supplied to another machine that is connected aside from LED lighting devices, and continues driving the other machine. This power supply device is equipped with a plurality of LED drive circuits provided in parallel, corresponding respectively to a plurality of LED lighting instruments to drive each of the LED lighting instruments in a predetermined light-emission mode. The plurality of LED drive circuits and the other machine are connected to a DC supply unit having such constitution that a direct current power supply voltage is converted into a predetermined direct current voltage and supplied thereby. The power supply device is further provided with a constant current circuit whereof the input side is connected to the DC supply unit and the other machine, and the output side is connected to the plurality of LED drive circuits.

4 Claims, 3 Drawing Sheets

RELATIONSHIP BETWEEN SUPPLY CAPACITY AND TOTAL OUTPUT VOLTAGE DURING STROBE EMISSION CAUSED BY RANDOM TRIGGER

(58) Field of Classification Search
USPC ..... 315/294, 297, 307, 122, 192, 224
See application file for complete search history.

(56) References Cited

U.S. PATENT DOCUMENTS

2007/0273290 A1* 11/2007 Ashdown ..... F21V 29/004 315/113
2010/0066257 A1* 3/2010 Lin ..... H05B 33/0827 315/161
2010/0096993 A1* 4/2010 Ashdown ..... F21V 29/004 315/113
2011/0115410 A1* 5/2011 Kim ..... H05B 33/0851 315/297
2012/0081014 A1* 4/2012 Blanchard ..... H05B 37/0272 315/185 R
2012/0248993 A1* 10/2012 Lin ..... H05B 33/0815 315/160
2012/0320627 A1* 12/2012 Araki ..... F21S 8/04 362/608
2013/0241433 A1 9/2013 Ge et al.
2013/0293379 A1* 11/2013 Rains, Jr. ..... G08B 15/00 340/541
2016/0255687 A1* 9/2016 Zhang ..... H05B 33/0818 315/210

FOREIGN PATENT DOCUMENTS

EP 2618635 A1 7/2013
JP 2012221714 A 11/2012
JP 2012243458 A 12/2012
JP 2013084557 A 5/2013

OTHER PUBLICATIONS

European Patent Office, Extended European Search Report Issued in European Application No. 15770171.5, dated Oct. 20, 2017, Germany, 7 pages.
The State Intellectual Property Office of the People's Republic of China, Office Action Issued in Chinese Application No. 201580004501.X, dated Jul. 6, 2017, 6 pages.

* cited by examiner

RELATIONSHIP BETWEEN SUPPLY CAPACITY AND TOTAL OUTPUT VOLTAGE DURING NORMAL LIGHT EMISSION

RELATIONSHIP BETWEEN SUPPLY CAPACITY AND TOTAL OUTPUT VOLTAGE DURING STROBE EMISSION CAUSED BY RANDOM TRIGGER

POWER SUPPLY DEVICE AND LED LIGHTING APPARATUS

TECHNICAL FIELD

The present invention relates to a power supply device to which LED luminaires are connected in parallel and that controls the light-emitting state of each LED luminaire, and an LED lighting apparatus including the power supply device.

BACKGROUND ART

For instance, an LED lighting apparatus is known that includes (i) a power supply device that receives power supply from a DC-DC converter for converting a DC power supply voltage into a predetermined DC voltage and includes LED driving circuits connected in parallel and to the output of the DC-DC converter and (ii) LED luminaires respectively connected to the LED driving circuits. As a device other than the LED luminaires, a sequencer or other equipment may be further connected in parallel to the power supply device. Thus, a predetermined DC voltage is supplied from the DC-DC converter to the device other than the LED luminaires.

In the LED lighting apparatus, if the LED driving circuits strobe the LED luminaires by random triggers, coincidence of light emission of each LED luminaire results in momentary excess output. This decreases a voltage supplied from the DC-DC converter. Thus, a voltage necessary for driving the sequencer cannot be supplied from the DC-DC converter, thereby stopping the operation of the sequencer. This may cause a serious problem in another device controlled by the sequencer.

Patent Literature 1 presents problems relating to excess output in an LED lighting apparatus in which LED luminaires are connected in parallel to a power supply device including an AC-DC converter for converting a commercial AC voltage into a predetermined DC voltage, instead of a DC-DC converter.

However, the objective of Patent Literature 1 is to prevent an excess current from flowing at the time of occurrence of the excess output, thereby preventing elements constituting the AC-DC converter from breaking down. Thus, if the excess output occurs, the output voltage of the AC-DC converter is decreased.

Thus, if a device other than the LED luminaires is connected to the AC-DC converter also in the power supply device in Patent Literature 1, the occurrence of the excess output results in a decrease in voltage supplied to the device and stops the function of the device. That is, the above problems cannot be solved by the technique of Patent Literature 1.

CITATION LIST

Patent Literature

PTL 1 Japanese Unexamined Patent Application Publication No. 2012-243458

SUMMARY OF INVENTION

Technical Problem

In view of these problems, the objectives of the present invention are to provide a power supply device capable of preventing a DC supply from decreasing a voltage supplied to a device other than LED luminaires even if excess output occurs at the LED luminaires, thereby keeping the driving of the device, and to provide an LED lighting apparatus including the power supply device.

Solution to Problem

That is, a power supply device according to the present invention includes LED driving circuits that are provided in parallel, respectively correspond to LED luminaires, and drive the LED luminaires in a predetermined light emission mode, in which the LED driving circuits and other device are connected to a DC supply that supplies a predetermined DC voltage converted from a DC power supply voltage, the other device being a device other than the LED driving circuits, and the power supply device further includes a constant current circuit whose input is connected to the DC supply and the other device and whose output is connected to the LED driving circuits.

In this power supply device, the constant current circuit is provided between the DC supply and the LED driving circuits. Thus, even if for example coincidence of light emission of each LED luminaire results in excess output and a large amount of power flows into the output of the constant current circuit, a current outputted from the constant current circuit is kept at a predetermined value. This limits power supplied from the DC supply to the LED driving circuits and the LED luminaires via the constant current circuit even in an excess output state.

Accordingly, power exceeding the supply capacity of the DC supply can be prevented from being supplied from the DC supply to the LED driving circuits and the LED luminaires via the constant current circuit. Thus, a voltage supplied from the DC supply to the other device can be prevented from decreasing, allowing the other device to continue to normally operate even in the excess output state.

That is, the input of the constant current circuit is less influenced by power demand at the output of the constant current circuit. Thus, a momentary voltage drop in a power supply line from the DC supply to the constant current circuit can be prevented, allowing the other device to normally operate at any time.

In order to detect the excess output state of the LED driving circuits and the LED luminaires, shortly end the excess output state, and further ensure the voltage supplied to the other device, the power supply device may further include: a voltage monitor that monitors a voltage at the output of the constant current circuit; and a light emission controller that limits output of the LED driving circuits when the voltage monitored by the voltage monitor falls below a predetermined threshold voltage.

In a specific embodiment in which a momentarily large amount of power may be generated in the LED driving circuits and the effects of protection of a voltage supplied to the other device in the present invention are more noticeable, for instance, the LED driving circuits may each include a capacitor, and strobe the LED luminaires.

The excess output state cannot be prevented by the control of the LED driving circuits. In view of this, in a specific embodiment that can most benefit from the effects of the protection of a voltage supplied from the DC supply to the other device in the present invention, for instance, the light emission controller may receive a random trigger command randomly specifying time when each of the LED luminaires is strobed, and control the LED driving circuits based on the random trigger command.

In an LED lighting apparatus including the power supply device of the present invention and the LED luminaires, the light emission modes of the LED luminaires can be freely controlled without considering problems relating to a decrease in voltage supplied to the other device in the excess output state.

Advantageous Effects

Thus, in the present invention, the constant current circuit is provided between the DC supply and the LED driving circuits. Thus, even if excess output occurs at the output of the constant current circuit, a voltage supplied from the DC supply connected to the input of the constant current circuit can be prevented from decreasing. Accordingly, even if the excess output occurs at the LED driving circuits and the LED luminaires, a predetermined DC voltage can be supplied to the other device connected between the DC supply and the constant current circuit. This can prevent a momentary decrease in voltage supplied to the other device due to the excess output. Thus, it is possible to sufficiently protect the other device vulnerable to the momentary decrease in voltage, such as a sequencer, a computer, an image processing device, or a touch panel. This allows the other device to continue to normally operate.

REFERENCE CHARACTER LIST

Figure 1:
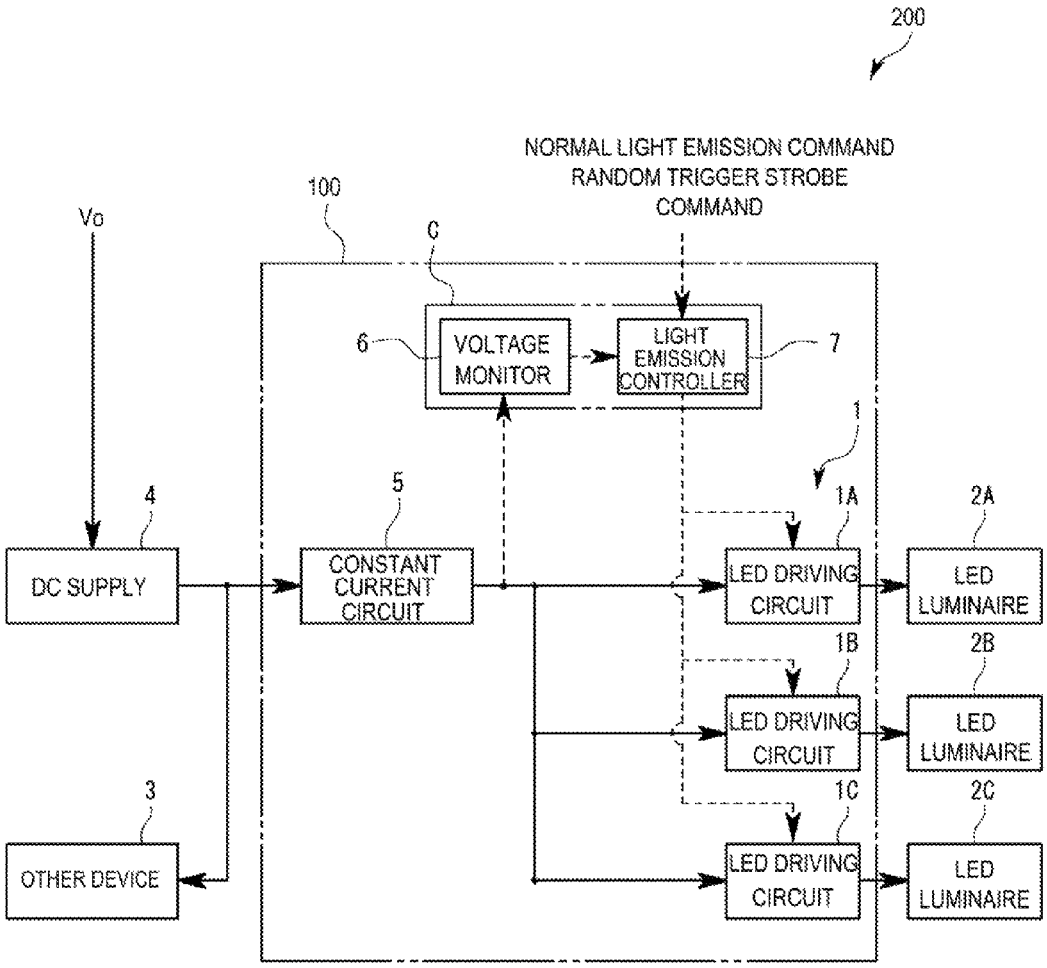
FIG. 1 is a schematic diagram of a power supply device and LED luminaires according to an embodiment of the present invention.

100 power supply device
200 LED lighting apparatus
1 LED driving circuit
2 LED luminaire
3 other device
4 DC supply
5 constant current circuit
6 voltage monitor
7 light emission controller

DESCRIPTION OF EMBODIMENTS

The following describes an embodiment of the present invention with reference to the drawings.

As FIG. 1 illustrates, an LED lighting apparatus 200 in the present embodiment includes a power supply device 100 and LED luminaires 2A, 2B, and 2C connected in parallel to the power supply device 100. The LED lighting apparatus 200 randomly strobes the LED luminaires 2A, 2B, and 2C by performing overdrive driving. It should be noted that the power supply capacity of the power supply device 100 is less than the maximum power considered necessary at the output of the power supply device 100 in order to reduce the size and cost. Moreover, in addition to the LED luminaires 2A, 2B, and 2C, an other device 3 that requires a DC voltage is connected to the power supply device 100. In the present embodiment, examples of the other device 3 include a sequencer and a display. However, equipment other than these examples can be also connected to the power supply device 100.

The following describes details of each element.

Two or more LED luminaires may be provided instead of the three LED luminaires 2A, 2B, and 2C in the present embodiment. Each LED luminaire includes LEDs. The number and layout of the LEDs may be different for each of the LED luminaires 2A, 2B, and 2C, or the LED luminaires 2A, 2B, and 2C may have the same configuration of the LEDs. By connecting the LED luminaires 2A, 2B, and 2C to the power supply device 100, the LED luminaires 2A, 2B, and 2C are controlled in a predetermined light emission mode. A suitable light emission mode is set to detect, for example, a flaw or a defect of a product, or the position by machine vision. In the present embodiment, the LED luminaires 2A, 2B, and 2C are controlled so as to be randomly strobed.

The power supply device 100 supplies DC voltages to the LED luminaires 2A, 2B, and 2C and the other device 3 that are connected to the power supply device 100. More specifically, as FIG. 1 illustrates, the power supply device 100 is connected to a DC supply 4 so as to receive a power supply from the DC supply 4. The power supply device 100 includes LED driving circuits 1A, 1B, and 1C provided in parallel, a constant current circuit 5 between the DC supply 4 and the LED driving circuits 1A, 1B, and 1C, and a control substrate C.

The LED driving circuits 1A, 1B, and 1C each include at least a capacitor storing power for strobing the LED luminaires 2A, 2B, and 2C and a switching element for controlling a current flowing through each of the LED luminaires 2A, 2B, and 2C.

The DC supply 4 is a DC-DC converter that steps up or down an input power supply voltage (e.g., 24 V) to a predetermined DC voltage, and outputs the voltage. The DC voltage outputted from the DC supply 4 is supplied not only to the LED luminaires 2A, 2B, and 2C, but also to the other device 3.

The constant current circuit 5 is provided separately from the DC supply 4 or the LED driving circuits 1A, 1B, and 1C. The DC supply 4 and the other device 3 are connected to the input of the constant current circuit 5. The LED driving circuits 1A, 1B, and 1C are connected to the output of the constant current circuit 5. The constant current circuit 5 limits a current value at the output to a constant value. For instance, the constant current circuit 5 limits the current value at the output so that the current value is less than or equal to a value obtained by dividing the power supply capacity of the DC supply 4 by the product of the predetermined DC voltage outputted from the DC supply 4 and the number of the LED luminaires 2A, 2B, and 2C. That is, the current value limited by the constant current circuit 5 is set so that the power supply capacity of the DC supply 4 is more than the sum total of the power consumption of the LED driving circuits 1A, 1B, and 1C and the LED luminaires 2A, 2B, and 2C. When the current value limited by the constant current circuit 5 is explained from another perspective, the limited current value is set so that flowing of an excess current activates the excess current protection function of an AC-DC converter (not illustrated) that generates a DC power supply voltage of 24 V from a commercial AC voltage, and the power supply voltage is prevented from decreasing from 24 V. For instance, when the current reaches or exceeds 105% of a normal rated current, the excess current protection function of the AC-DC converter is activated. In the present embodiment, the constant current circuit 5 limits the current value to 102% of the rated current. That is, the current value limited by the constant current circuit 5 is set on the basis of the rated current of the AC-DC converter, which generates a DC power supply voltage from an AC voltage, and is set to be less than the current value at which excess current protection function is activated.

The control substrate is a computer including, for example, a CPU, memory, an AC-DC converter, and an input/output device. Execution of a program for the power supply device 100 stored in the memory at least enables the control substrate to function as a voltage monitor 6 and a light emission controller 7.

Figure 2:
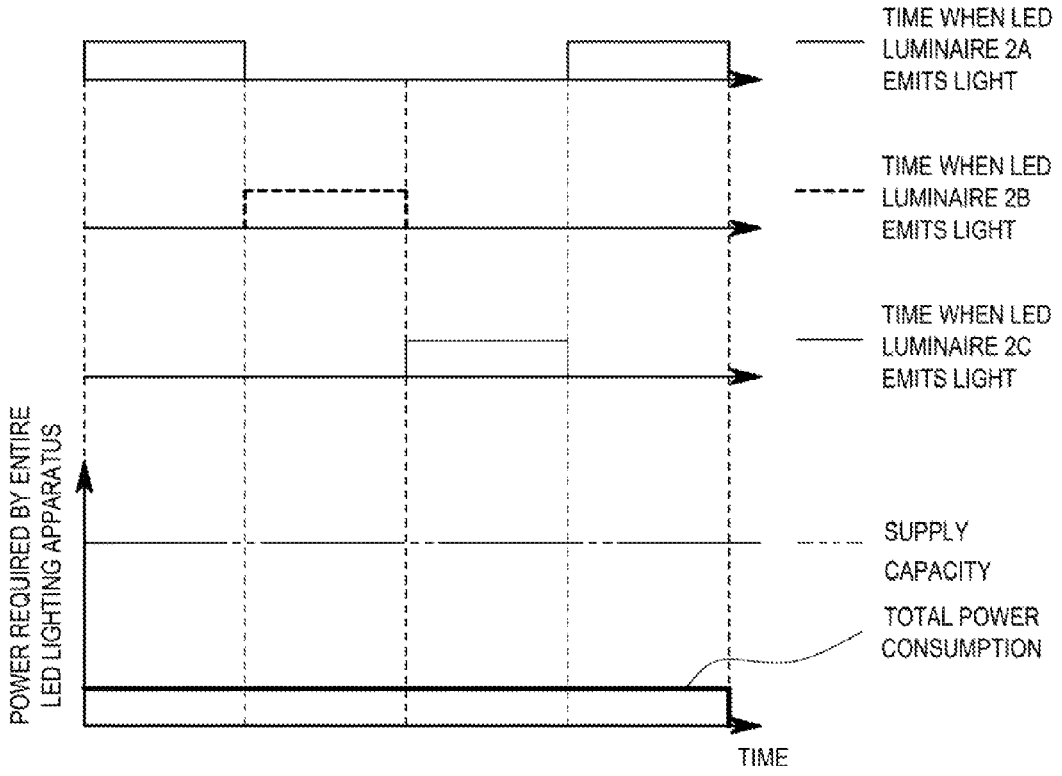
FIG. 2 is a schematic graph illustrating the light-emitting state of each LED luminaire during normal light emission and power required by an entire LED lighting apparatus in the embodiment.
Figure 3:
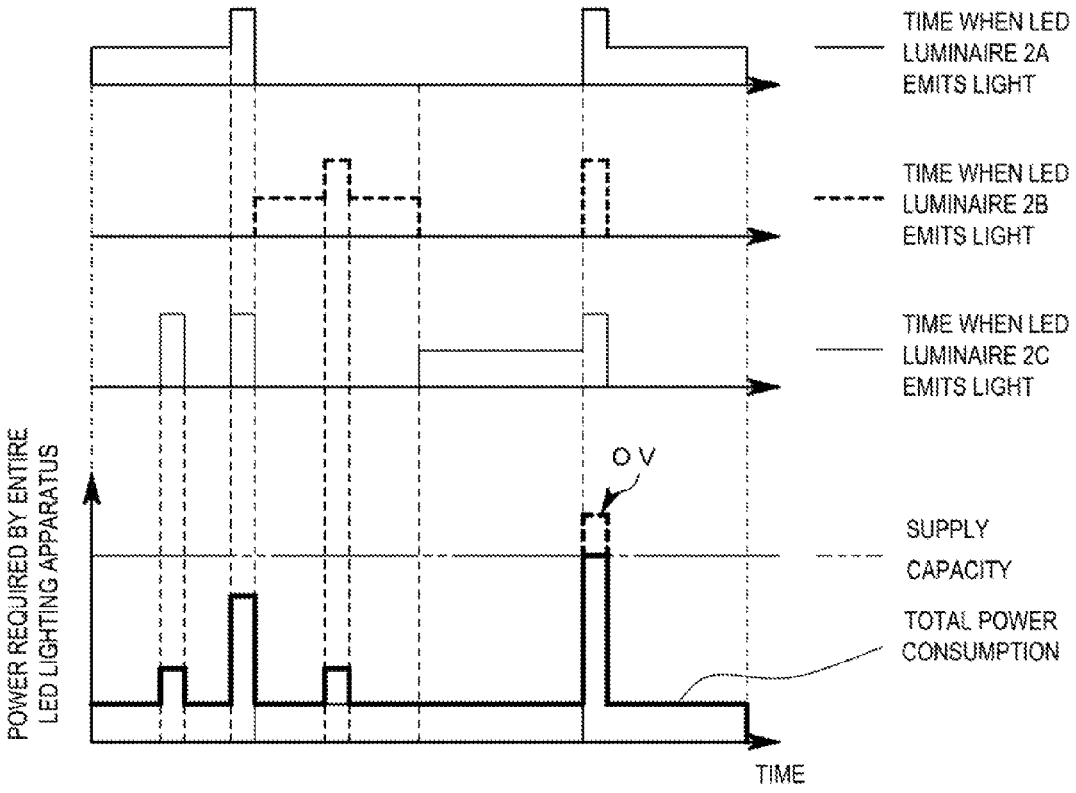
FIG. 3 is a schematic graph illustrating the light-emitting state of each LED luminaire strobed by a random trigger and power required by the entire LED lighting apparatus in the embodiment.

The light emission controller 7 controls the operations of the LED driving circuits 1A, 1B, and 1C and the light emission modes of the LED luminaires 2A, 2B, and 2C. In the present embodiment, the light emission controller 7 performs pulse width modulation (PWM) control on the switching elements of the LED driving circuits 1A, 1B, and 1C. As FIG. 2 illustrates, the light emission modes of the LED luminaires 2A, 2B, and 2C are controlled so that the LED luminaires 2A, 2B, and 2C normally emit light at different times. That is, the LED luminaires 2A, 2B, and 2C do not normally emit light at the same time. Thus, the sum total of power consumption of the LED driving circuits 1A, 1B, and 1C and the LED luminaires 2A, 2B, and 2C significantly falls below the power supply capacity of the DC supply 4. Moreover, the light emission controller 7 controls the LED driving circuits 1A, 1B, and 1C so that the LED luminaires 2A, 2B, and 2C are individually strobed on the basis of input random trigger commands. More specifically, the light emission controller 7 performs control so that as FIG. 3 illustrates, strobe emission commands can be randomly overdriven (cf. the normal light emission patterns in FIG. 2). At the time of strobe emission, the strobe emission commands are randomly inputted to the LED driving circuits 1A, 1B, and 1C. In some cases, the strobe emission commands are simultaneously inputted to the LED driving circuits 1A, 1B, and 1C. As FIG. 3 illustrates, momentary power consumption may significantly exceed the power supply capacity of the DC supply 4. That is, random triggers may cause momentary excess output OV.

The voltage monitor 6 monitors the output voltage of the constant current circuit 5, and checks whether the output voltage falls below a threshold voltage. If the excess output OV occurs at the output of the constant current circuit 5, a voltage drop is caused by the constant current circuit 5. Thus, the voltage monitor 6 detects the occurrence of the excess output OV by the voltage drop.

If the voltage monitor 6 detects a decrease in the output voltage of the constant current circuit 5, the light emission controller 7 limits the output voltages and output currents of the LED driving circuits 1A, 1B, and 1C. For instance, to shortly end the state of the excess output OV, the light emission controller 7 performs control so as to prevent any of the LED luminaires 2A, 2B, and 2C from emitting light. A threshold voltage of the voltage monitor 6 is set so that if the excess output OV occurs, protection operations can be sufficiently performed by limiting the output voltages and output currents of the LED driving circuits 1A, 1B, and 1C. More specifically, the degree of a voltage drop at the output of the constant current circuit 5 caused when the excess output OV occurs is determined by the capacitance of the capacitors provided in the LED driving circuits 1A, 1B, and 1C. Thus, electric energy discharged from the detection of the voltage drop by which the voltage falls below the threshold voltage of the voltage monitor 6 to the start of the protection operations by the output limitation can be estimated on the basis of the capacitance. The threshold voltage is set so that the electric energy discharged until the start of the protection operations does not affect the other device 3. That is, in the present embodiment, the threshold voltage is set on the basis of, for example, the capacitance of each capacitor, discharged electric energy, or a time period from the detection to the start of the protection operations.

Even if the power supply device 100 and the LED lighting apparatus 200 having the above configurations cause the excess output OV in the LED driving circuits 1A, 1B, and 1C and the LED luminaires 2A, 2B, and 2C, a predetermined DC voltage is supplied to the other device 3 via the constant current circuit 5.

FIG. 3 illustrates the LED luminaires 2A, 2B, and 2C strobed by the random triggers. The right-hand side of the graph illustrates unintended coincidence of strobe emission of the LED luminaires 2A, 2B, and 2C. In the case of the coincidence of strobe emission of the LED luminaires 2A, 2B, and 2C as illustrated in FIG. 3, the excess output OV momentarily occurs in a conventional power supply device 100 (dotted line of OV in FIG. 3). However, in the present embodiment, the constant current circuit 5 is provided between the DC supply 4 and the LED driving circuits 1A, 1B, and 1C. There is an upper limit to the current values of currents flowing through the LED driving circuits 1A, 1B, and 1C and the LED luminaires 2A, 2B, and 2C. Thus, power consumption at the output of the constant current circuit 5 is limited so as not to substantially exceed the power supply capacity of the DC supply 4 (solid line of OV in FIG. 3). Accordingly, it is possible to prevent a voltage drop in the power supply line between the DC supply 4 and the constant current circuit 5 due to excess currents flowing into the capacitors of the LED driving circuits 1A, 1B, and 1C. This can keep a voltage applied to the other device 3 connected to the power supply line at a certain level.

Thus, even if the excess output OV occurs, the voltage supplied to the other device 3 can be substantially kept at a predetermined DC voltage. This can prevent the other device 3 from ceasing to function.

Moreover, when the voltage monitor 6 detects a voltage drop at the output of the constant current circuit 5, the light emission controller 7 limits the power consumption of the LED driving circuits 1A, 1B, and 1C and the LED luminaires 2A, 2B, and 2C. Thus, the state of the excess output OV shortly ends, and a voltage drop in the power supply line can be more reliably prevented.

The following describes another embodiment.

The power supply device may include a DC supply.

The number of the LED driving circuits in the above embodiment may be two. Likewise, the number of the LED luminaires in the above embodiment may be two. Such LED driving circuits and LED luminaires can benefit from the advantageous effects of the present invention. The other device is not limited to the above examples, but may be equipment other than the LED luminaires that are control objects of light emission modes. For instance, the other device may be equipment that is vulnerable to a voltage drop and loses its function when the voltage decreases. Examples of the other device include a computer, an image processing device, and a touch panel.

Moreover, the strobe emission function may be omitted, and control may be performed by random triggers that may result in coincidence of light emission of each LED luminaire. Even in this case, if excess output occurs, a voltage supplied to the other device can be protected. That is, the LED driving circuits are not limited to circuits that strobe the LED luminaires, but may be circuits that only perform the PWM control. The LED driving circuits may be circuits that drive the LED luminaires in a predetermined light emission mode. For instance, excess output due to the coincidence of light emission of each LED luminaire caused by the PWM control and an excess current due to shorting of the LED luminaires or the LED driving circuits may occur depending on the supply capacity and the number and modes of the LED luminaires. This may decrease a voltage supplied to the other device. However, the present invention is also effective for such a case. Thus, the present invention is applicable to a power supply device and an LED lighting apparatus in which these light emission modes are employed.

Various modifications and combinations of the embodiments are possible without departing from the scope of the present invention.

INDUSTRIAL APPLICABILITY

The present invention can provide the power supply device and the LED lighting apparatus which can prevent a momentary voltage drop in the other device due to excess output, sufficiently protect the other device vulnerable to the momentary voltage drop, such as a sequencer, a computer, an image processing device, or a touch panel, and allows the other device to continue to normally operate.

The invention claimed is:

1. A power supply device comprising a plurality of LED driving circuits that are provided in parallel, respectively correspond to a plurality of LED luminaires, and drive the plurality of LED luminaires in a predetermined light emission mode; and a light emission controller that controls operations of the plurality of LED driving circuits and light emission modes of the plurality of LED luminaires, wherein the plurality of LED driving circuits and other device are connected to a voltage converter that supplies a predetermined DC voltage converted from a power supply voltage, the other device being a device other than the plurality of LED driving circuits, the power supply device further includes a constant current circuit whose input is connected to the voltage converter and the other device and whose output is connected to the plurality of LED driving circuits, and the light emission controller receives a random trigger command randomly specifying a time when each of the plurality of LED luminaires is strobed, and controls the plurality of LED driving circuits based on the random trigger command.

2. The power supply device according to claim 1, further comprising:

a voltage monitor that monitors a voltage at the output of the constant current circuit, wherein the light emission controller limits output of the plurality of LED driving circuits when the voltage monitored by the voltage monitor falls below a predetermined threshold voltage.

3. The power supply device according to claim 1, wherein the plurality of LED driving circuits each include a capacitor.

4. An LED lighting apparatus comprising:

the power supply device according to claim 1, wherein a plurality of lines connect between the plurality of LED driving circuits and the plurality of LED luminaires.

* * * * *